US007913608B1

(12) United States Patent
Ljungwald et al.

(10) Patent No.: US 7,913,608 B1
(45) Date of Patent: Mar. 29, 2011

(54) WEAPON WITH IM-CHARACTERISTICS

(75) Inventors: Niclas Ljungwald, Eskilstuna (SE); Peter Tuikkanen, Eskilstuna (SE); Örjan Ariander, Huddinge (SE)

(73) Assignee: SAAB AB, Linköping (SE)

( * ) Notice: Subject to any disclaimer, the term of this patent is extended or adjusted under 35 U.S.C. 154(b) by 154 days.

(21) Appl. No.: 12/432,945

(22) Filed: Apr. 30, 2009

(30) Foreign Application Priority Data

Apr. 30, 2008 (EP) ..... 08155470

(51) Int. Cl.
*F41A 21/00* (2006.01)

(52) U.S. Cl. ..... 89/30

(58) Field of Classification Search ..... 89/30; 102/481; 60/223

See application file for complete search history.

(56) References Cited

U.S. PATENT DOCUMENTS 3,927,791 A * 12/1975 Hershberger ..... 220/89.4
5,035,180 A * 7/1991 Purcell et al. ..... 102/481
5,129,326 A * 7/1992 Brogan ..... 102/481
5,228,285 A * 7/1993 Van Name et al. ..... 60/253
5,564,272 A * 10/1996 Warner et al. ..... 60/223
5,939,662 A * 8/1999 Bootes et al. ..... 102/473
6,321,656 B1 * 11/2001 Johnson ..... 102/377
6,338,242 B1 * 1/2002 Kim et al. ..... 60/204
2002/0020323 A1 2/2002 Dassis
2005/0193917 A1 * 9/2005 Friedlander, III ..... 102/481
2007/0095239 A1 5/2007 Skinner

FOREIGN PATENT DOCUMENTS

EP 0163086 A 12/1985
EP 1170568 A2 1/2002
EP 1808664 A1 7/2007
WO WO-2005/116573 A1 12/2005

OTHER PUBLICATIONS

European Search Report—Nov. 11, 2008.

* cited by examiner

*Primary Examiner* — Troy Chambers
(74) *Attorney, Agent, or Firm* — Venable LLP; Eric J. Franklin

(57) ABSTRACT

A weapon having a barrel or launch tube for a projectile or shell preloaded therein together with a propellant charge. An active vent is configured on the barrel for preventing accidental firing of the shell if the weapon becomes overheated.

10 Claims, 4 Drawing Sheets

WEAPON WITH IM-CHARACTERISTICS

CROSS-REFERENCE TO RELATED APPLICATIONS

This application claims priority to European patent application 08155470.1 filed 30 Apr. 2008.

BACKGROUND OF THE INVENTION

1. Technical field of the Invention

The present invention relates to a preloaded recoilless gun of a disposable type as an AT4, AT4 CS, AT4 CS AST and other equally valuable support weapons, which are normally ready for missions requiring an immediate action of effective fire. More particularly, the invention relates to a weapon having a barrel or launch tube and a projectile or shell preloaded therein together with a propellant charge, which is pro-vided with means for providing, so called, IM (Insensitive Munitions) characteristics during all kinds of operations, be it handling, transport and storing or standing by for immediate firing of support weapons of the indicated type.

2. Description of Related Art

When handling, transporting and storing, or being in a state of alert with, weapons of the initially mentioned kind, e.g. individually, during troop movements, trans-porting and storing in boxes, during attacking or defending progress or otherwise, there is in some cases a potential chance of an accidental firing of the propellant charge and a closely following detonation, if the shell should exit the barrel of the weapon, which would lead to possible fatal consequences.

Certain standard tests have been set for testing weapons, ammunition and missiles to determine if these fulfil safety criteria in this respect. Examples of such tests are "Bullet impact test", "Fragment impact test", "Fast Cook-off test" and "Slow Cook-off test". If those tests show that a weapon system tested acts within acceptable limits, such a system is classified as an Insensitive Munition (IM) weapon system.

In this connection, reference might be made to US-A1-2005/0193917, which shows an example of a passive venting apparatus and method for a rocket motor or ordnance device containing propellant or explosive material enclosed in a case, which presents an explosion hazard when subjected to external heat. An alternative example configured with an IM-lock for weapons having preloaded projectiles is disclosed in EP-A1-1808664. In this example, when a certain temperature is reached, the inner area of the barrel is deformed by means of an element of SMA (Shape Memory Alloy).

It is desirable to provide enhanced IM-characteristics to such extent that the "Fast Cook-off" test is passed, that is the active venting means will start a venting in a shorter time after heating is commenced than with a passive venting system. One irrevocable demand is that the overpressure in the charge chamber is vented before the propellant charge detonates. Further, in certain cases it is desirable that all fragments and debris are kept within a radius of 15 m from the fire site.

However, up till now the related technical field of preloaded recoilless guns of the initially mentioned disposable type lacks a suitable solution regarding providing an improved wenting means adapted for use in providing enhanced IM-characteristics.

SUMMARY OF THE INVENTION

It is an object of the present invention to provide an improved venting means for a preloaded gun of the initially mentioned kind which is capable of preventing a shell from exiting the barrel of the weapon should the propellant charge of the shell be at a risk of accidentally ignition, and thereby preventing an accidental explosion of the shell in the vicinity.

For this purpose a weapon having a barrel or launch tube and a projectile or shell preloaded therein together with a propellant charge according to the present invention is characterized by active venting means configured on said barrel for preventing accidental firing of the shell if said weapon becomes overheated.

Further features of the weapon system of the invention will be apparent from the following detailed description and the appended dependent claims with reference to the accompanying schematic drawing.

ADVANTAGES

By means of the active venting means configured on the barrel of the weapon according to the present invention, it is possible to operate a ready-to-fire weapon in combat, which nevertheless, even in combat meets very high IM-standards.

Further advantages involve the possibility of initiating an active venting of a complete weapon ready for action, without any need of dismantling the weapon by for example dismounting the nozzle or the counter mass container or unloading the cartridge.

BRIEF DESCRIPTION OF THE DRAWINGS

The invention is described in more detail in the following with reference to the accompanying schematic drawings. Corresponding details have been allotted the same reference numerals in the different embodiments.

DESCRIPTION OF EMBODIMENTS OF THE INVENTION

Figure 1:
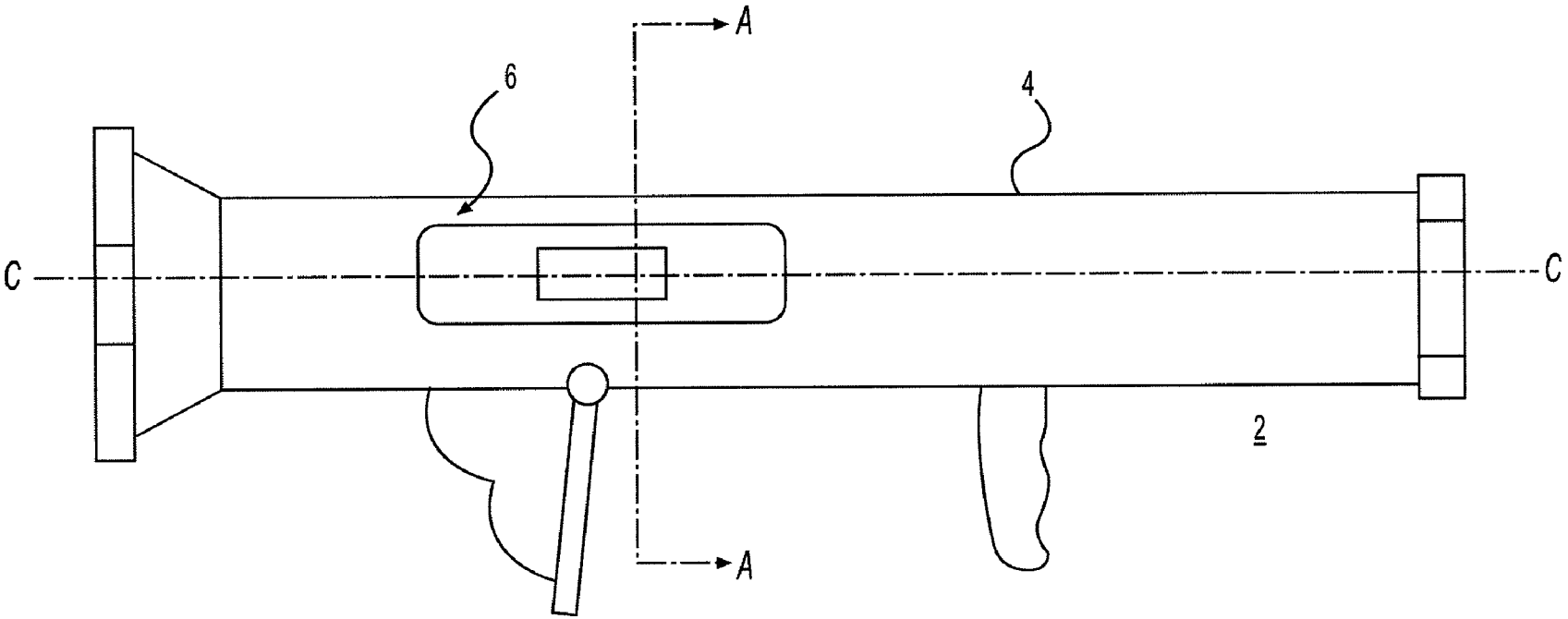
FIG. 1 is a side view of a weapon provided with a cutting charge on the outside of the barrel.

FIG. 1 is a side view of a weapon 2 of the initially mentioned kind comprising a barrel 4 or launch tube for a not shown projectile or shell preloaded therein together with a propellant charge 8. Said barrel 4 is provided with an active venting means configured by a cutting charge 6 attached to the outside of a section of the barrel, in which the chamber preloaded with the propellant charge 8 is located. The barrel 4 of a weapon of this kind is normally made of fiber reinforced plastic (glass-fiber, carbon-fiber etc.). It appears that the cutting charge 6 preferably is arranged on the side of the weapon which is normally turned from the shot, in FIG. 1 this is the right side of the weapon seen in the firing direction. Further, it appears that the cutting charge can be a linear charge 6 extended parallel to the center line of the weapon 2.

Figure 2:
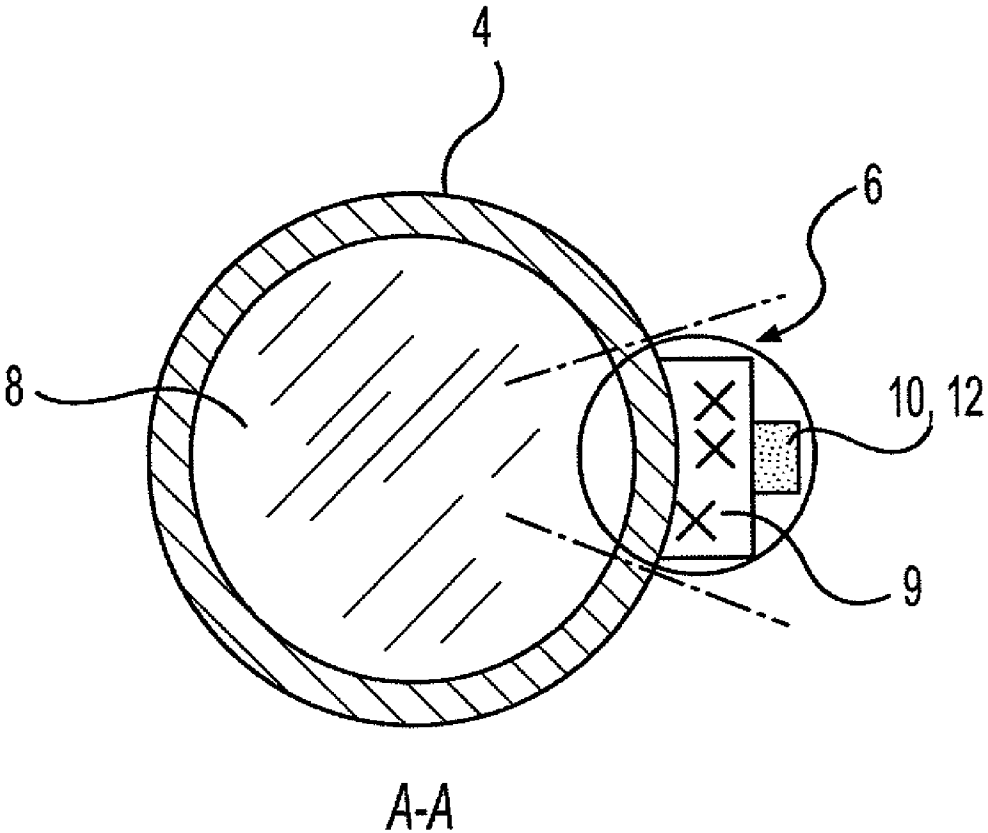
FIG. 2 is a cross section through line A-A of FIG. 1.

FIG. 2 is a cross section through line A-A of FIG. 1 and depicts the propellant charge 8 and the linear charge 6 separated only by the material in the wall of the barrel 4. A simple embodiment of a linear charge might comprise just a piece of conventional explosive 9, like octol, trotyl, pentyl or other equally valuable explosives provided with a common detonator 10, e.g. a primer charge on a powder base, which might be supplemented by an appropriate heat sensitive initiator 12. At a predetermined temperature in the environment around the weapon 2, either the initiator will start the progress of explosion by activating the detonator, or alternatively the detonator itself, which in turn will cause the detonation of the explosive. For the above mentioned AT4-weapon system, due to the heat insulating ability of the barrel, at least initially, the predetermined temperature advantageously might be substantially higher than the ignition temperature of the propellant charge, which preferably could be found in the vicinity of 140° C., which is the ignition temperature for regular powder.

After some time of heating by e.g. a fire, the temperature will be balanced between the outside and the inside of the barrel 4.

This warming up of the propellant charge on the inside of the barrel would take a longer time than warming up the detonator 10 which unshielded is located on the outside of the barrel 4. Therefore, even if the propellant charge and the detonator have essentially the same ignition temperature, of approx. 140° C., it would be satisfactory secured that the detonator will cause the detonation of the explosive 9, at least 15-30 minutes before the propellant charge 8 would self-ignite.

Then, the detonation of said peace of explosive will normally, if the barrel 4 is made of glass-fiber reinforced plastic, be sufficiently powerful to weaken or perforate and open up the wall of the barrel and cause an appropriate ventilation of powder gas from the propellant charge 8.

Appropriate ventilation achieved is preferably defined as breaking through or at least weakening of the material in the wall of the barrel 4. In the latter case the weakening of the material must be of such a magnitude that the remaining strength of the wall of the barrel is lower than the strength of the releasable fittings of the projectile and the brake indications of a possible counter mass (i.e. the barrel is caused to burst and ventilate powder gas before the projectile and/or the counter mass come loose).

In order to prevent ignition during normal firing it is required that the detonator and initiator be well isolated from the charge chamber of the weapon. Usually, this is achieved in that the wall of the barrel 4 it self provides some isolation effect. Further, when attaching the linear charge 6 to the barrel 4 it appears natural to configure the detonator 10 and initiator 12 on the side of the charge which is turned away from the barrel. In this way even the charge contributes to the isolation effect. If a still higher standard of isolation of the charge 6 is required, a not shown heat isolation layer of a conventional kind, for example Styrofoam or similar, might be applied between barrel and charge.

Further, it might be advantageous to control the detonation of the explosive 9 more precisely, in order to make time to extinguish the fire or remove the weapon from the fire site without risking that the linear charge 6 goes off without due cause.

Figure 3:
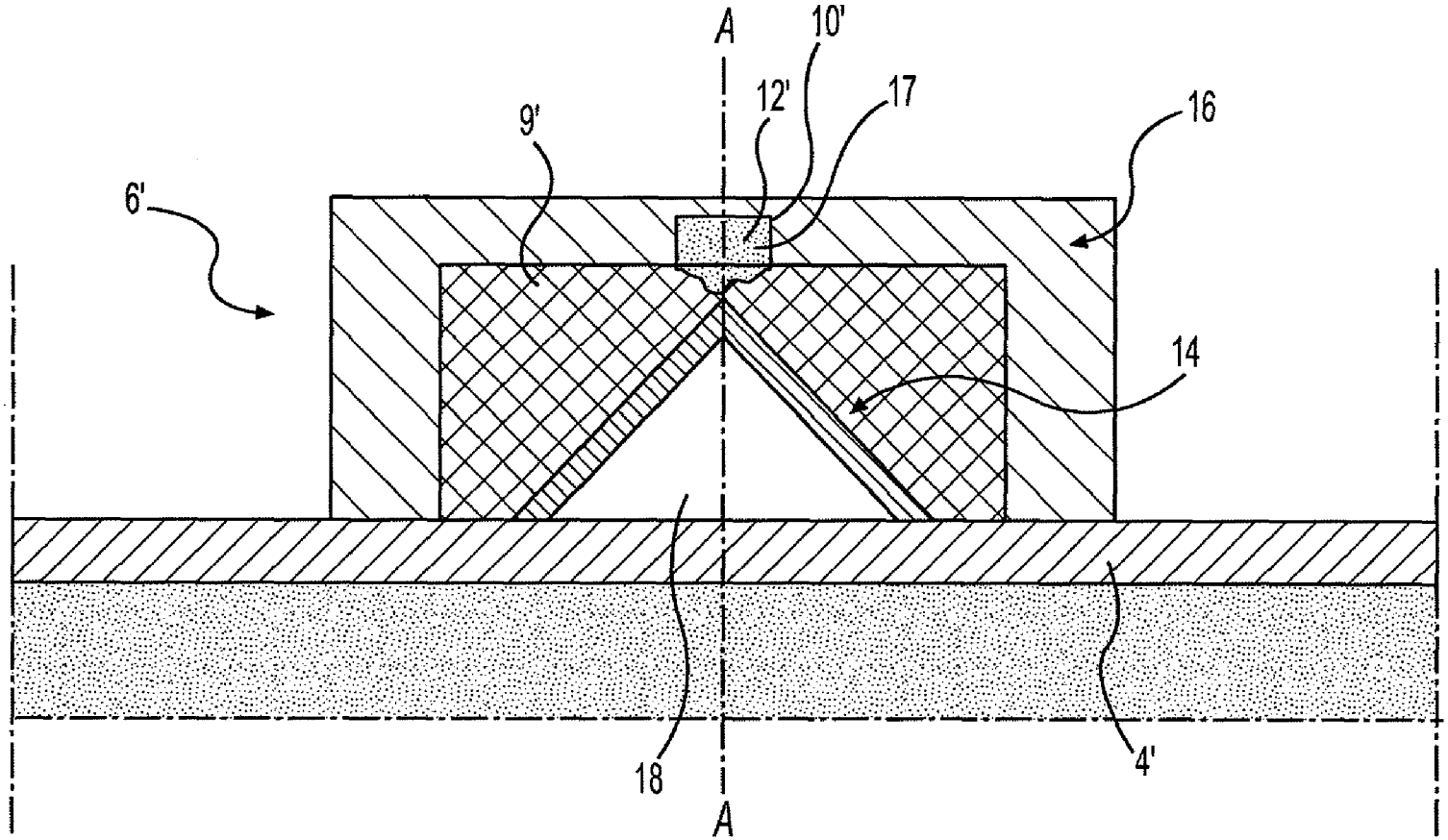
FIG. 3 is an enlarged cross-sectional view of a linear charge having a V-shaped profile, a linear shaped charge (LSC), attached to a cut-out part of the wall of the barrel.

FIG. 3 discloses an advantageous embodiment of an enlarged cross-sectional view of a charge having a V-shaped profile, a linear shaped charge (LSC) 6', attached to a cut-out part 4' of the wall of the barrel 4. The LSC 6' can be provided with a liner 14 with V-shaped profile. The liner is surrounded with explosive 9', the explosive then encased within a suitable casing material 16 that serves to protect the explosive and to confine (tamp) it on detonation. The in this way configured LSC 6' is suitable for barrels or launch tubes preferably made of metal and having a relatively large wall thickness.

The liner 14 can be made from many materials, including glass and various metals. The deepest penetrations can be achieved with a dense, ductile metal as e.g. copper. Also molybdenum and pseudo-alloys of tungsten filler and copper binder (9:1 thus density is ~18 t/m$^3$) have been adopted.

The charge is detonated by means of a combined initiator 12' and detonator 10' (primer charge) at some point in the explosive above the apex of the liner 14. This primer charge 10', 12' is extended into a recess 17 in the casing material 16. Hence, it would be possible to control the required time for heating of the primer charge 10', 12' up to its self-igniting temperature of approx. 140° C. by designing the thickness of the remaining casing material 16 between the recess 17 and the environment to an appropriate size. An optimal condition would be that the linear charge 6 be detonated just a few seconds before the propellant charge is to self-ignite.

However, for safety reasons it is desirable to achieve a satisfactory margin of about 5 minutes between the linear charge 6 be detonated and the propellant charge would have detonated if self-ignited. Experimental work has shown that these time parameters can be achieved if the thickness of the casing material 16 encasing the explosive 9' is related to the thickness of the remaining casing material 16 between the recess 17 and the environment as 1 to 5 (1:5).

Between the liner 14 and the wall of the barrel 4' a cavity 18 appears, through which the detonation of the explosive projects the liner 14 to form a continuous, knife-like jet. Hence, the V-shaped profile focuses the effect of the explosive's energy to said knife-like jet. The jet cuts any material in its path, to a depth depending on the size and materials used in the charge. Therefore, to cut through the wall of the barrel 4, it would be appropriate with an LSC of a miner size, e.g. with a weight of 0,002-0,005 kg.

In practical use it might be possible to achieve sufficient penetration without use of the liner 14.

Figure 4:
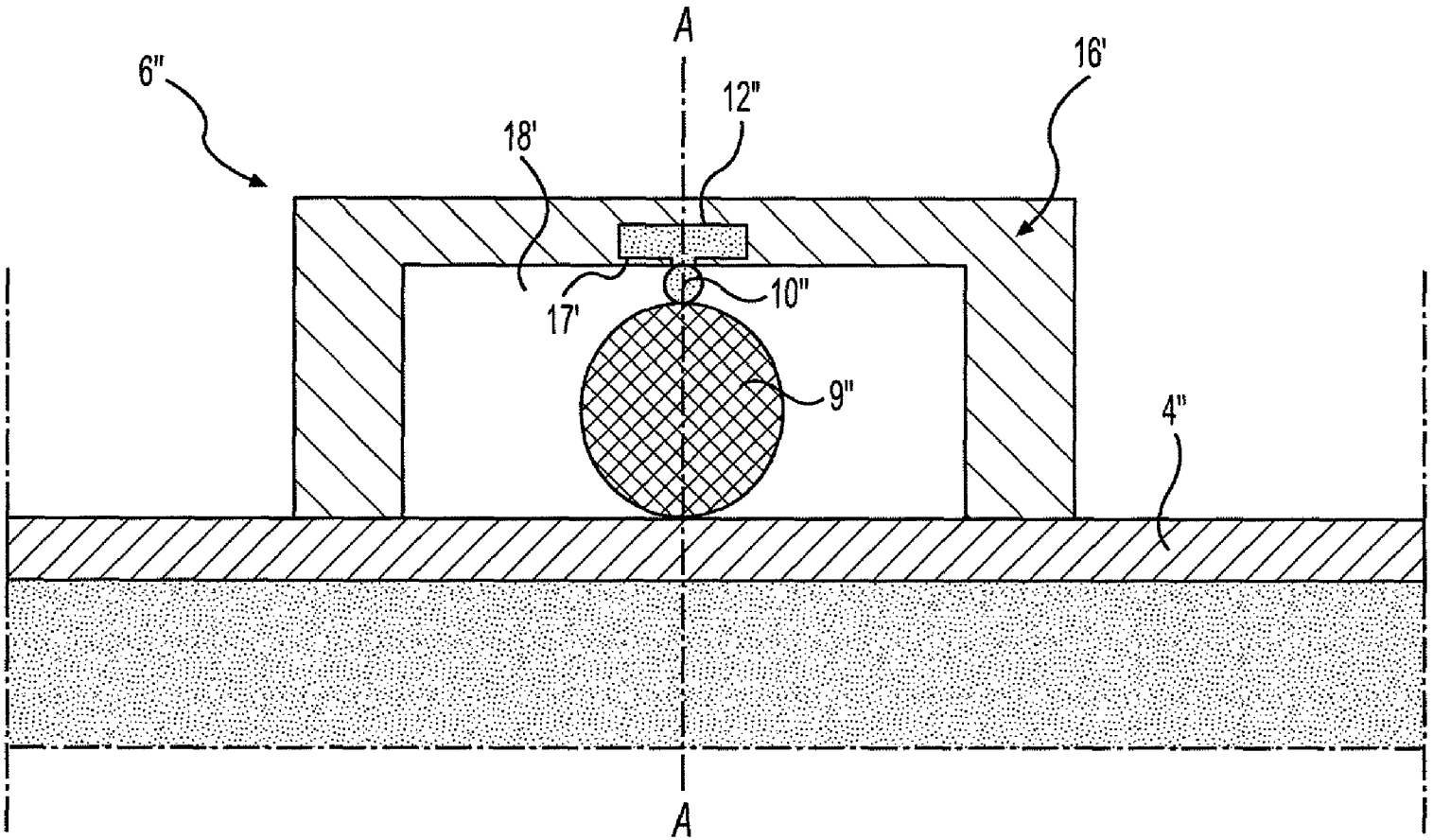
FIG. 4 is a cross-sectional view like FIG. 3 but with a linear charge having a cylindrical profile.

FIG. 4 is a cross-sectional view like FIG. 3 but with an LSC 6" the explosive of which is given a circular profile. Advantageously, the circular profile is achieved by means of a pentyl detonation fuse (cordtex fuse) 9", which can be arranged to a desirable length and in one or more layers depending on the required explosive effect. For the sake of clarity, said fuse 9" is disclosed in section of just one circular profile. In this embodiment no liner is provided, but the fuse 9" can impact by direct contact against the barrel 4". The in this way configured LSC 6" is suitable for relatively thin plastic barrels.

Even in this embodiment, the explosive is then encased within a suitable casing material 16' that serves to protect the explosive and to confine (tamp) it on detonation. The fuse 9" is here surrounded by a cavity 18', which is formed between the cut-out part 4" of the wall of the barrel and the casing material 16'. Like in FIG. 3, the charge is detonated by means of the initiator 12" and detonator 10", e.g. a conventional blasting cap 10 initiated by a primer charge 12, preferably at some point in the upper part of the fuse 9" (or a bundle of fuses). The primer charge 12 is even in this embodiment extended into a recess 17 for the same reasons as described above. In this case, to cut through the wall of the barrel 4", a reasonable dimension of the fuse with a length of 80 mm and a diameter of 3-7 mm would be appropriate for the LSC.

According to an advantageous, not shown embodiment, the LSC might be shaped and configured to cut an opening of a certain design, for example a U-shaped slot, which allows the wall of the barrel 4 to be bent out without completely getting loose from the wall. Alternatively, the design of the LSC might be in the form of a circular or square shaped ring, if it is desired to the contrary that a part of the wall be cut loose from the wall.

Even if not described specifically, in some case it might be advantageous if the linear charge is of a curved configuration and extended tangentially to the barrel.

The invention claimed is:

1. A weapon, comprising:

a barrel or launch tube for a projectile or shell preloaded therein together with a propellant charge; and an active vent configured on said barrel for preventing accidental firing of the shell if said weapon becomes overheated.

2. The weapon according to claim 1, wherein said active vent is configured for cutting through a wall of the barrel at least one opening connecting the propellant charge with a surrounding atmosphere when a predetermined temperature is reached in an environment around the weapon.

3. The weapon according to claim 1, wherein said active vent includes at least one linear charge.

4. The weapon according to claim 1, wherein said active vent includes at least one tamped linear charge.

5. The weapon according to claim 3, wherein said charge is longitudinally arranged to an outside of the barrel.

6. The weapon according to claim 3, wherein said charge is transversely arranged to an outside of the barrel.

7. The weapon according to claim 3, wherein an explosive of said charge comprises octol, trotyl, pentyl or other equally valuable explosives.

8. The weapon according to claim 3, wherein the charge is a cutting charge.

9. The weapon according to claim 8, wherein said cutting charge is a linear shaped charge.

10. The weapon according to claim 8, wherein said cutting charge is a pentyl detonation cord or fuse.

* * * * *